US008864509B2

(12) United States Patent
Strahl et al.

(10) Patent No.: US 8,864,509 B2
(45) Date of Patent: Oct. 21, 2014

(54) ROCKET LAUNCHER CONNECTOR ASSEMBLY

(71) Applicant: Amphenol Corporation, Wallingford, CT (US)

(72) Inventors: Erik Strahl, Unadilla, NY (US); Ritch Allen Selfridge, Bainbridge, NY (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 13/779,214

(22) Filed: Feb. 27, 2013

(65) Prior Publication Data

US 2014/0242831 A1 Aug. 28, 2014

(51) Int. Cl.
*H01R 13/62* (2006.01)
*H01R 13/629* (2006.01)

(52) U.S. Cl.
CPC ..... *H01R 13/629* (2013.01); *Y10S 439/923* (2013.01)
USPC ..... 439/154; 439/923

(58) Field of Classification Search
USPC ..... 439/152–159, 352, 374; 89/1.811
See application file for complete search history.

(56) References Cited

U.S. PATENT DOCUMENTS

| | | | |
|---|---|---|---|
| 4,184,731 | A | 1/1980 | Betzmeir |
| 4,291,931 | A | 9/1981 | Stupay |
| 4,350,074 | A | 9/1982 | Rouget et al. |
| 4,455,916 | A | 6/1984 | Whittaker |
| H405 | H | 1/1988 | Covey |
| 5,168,119 | A | 12/1992 | Sands |
| 5,983,771 | A | 11/1999 | Lehr |
| 6,499,526 | B1 | 12/2002 | St. Amand et al. |
| 6,971,300 | B2 | 12/2005 | Kunstmann |
| 7,070,434 | B2 | 7/2006 | Paul et al. |
| 2012/0055322 | A1 | 3/2012 | Angeloff et al. |

FOREIGN PATENT DOCUMENTS

| | | |
|---|---|---|
| EP | 148435 | 6/1988 |

*Primary Examiner* — Khiem Nguyen
(74) *Attorney, Agent, or Firm* — Blank Rome LLP

(57) ABSTRACT

A rocket launcher connector assembly that comprises a first connector component coupled to a launch tube and a second connector component is coupled to a rocket. The second connector component includes an interface side configured to engage the mating interface of the first connector component. Spring members of the second component have rounded portions for engaging contact pads of the first component. A housing of the assembly has a connector holding portion for holding the first and second components. The connector holding portion defines an alignment channel that supports the first component and the alignment member is slidably received in the alignment channel in an insert direction. A tolerance member is engaged with both the alignment member and the connector holding portion of the housing, wherein as the alignment member slides in the alignment channel, the tolerance member biases the alignment member in a direction opposite the insert direction.

13 Claims, 9 Drawing Sheets

ROCKET LAUNCHER CONNECTOR ASSEMBLY

FIELD OF THE INVENTION

The present invention relates to a connector assembly for a low profile rocket launcher that reduces erosion, is reusable, and provides a blind mating engagement feature.

BACKGROUND OF THE INVENTION

Conventional launcher connectors are typically bulky making it difficult to position launchers close to one another. Conventional low profile electrical connectors used with small diameter rocket launching systems typically degrade or erode due to the environment in which the connector components are used. Additionally, the components of low profile launching systems are not designed to be reusable. Moreover, it is often difficult to assemble corresponding mating pairs of conventional connectors because of the inability to view the components in the launcher, and the inability of the components to self-align.

Therefore, a need exists for a rocket launcher connector assembly that has a low profile, reduces erosion, has reusable components, facilitates blind mating of the components, and has a low profile.

SUMMARY OF THE INVENTION

Accordingly, the present invention provides a contact member that comprises a dielectric body that has opposite first and second ends and opposite first and second sides that extend between the first and second ends, and the first side is a mating interface for engaging a mating contact. The dielectric body has at least first and second steps and a sloped surface therebetween. The sloped surface slopes in a direction from the first end to the second end such that a depth of the first side at the first end is smaller than a depth of the first side at the second end. At least first and second contacts are supported by the dielectric body in the first and second steps, respectively. Each of the first and second contacts have a substantially flat pad at one end and a tail at an opposite end, wherein the pads are exposed at the first side of the dielectric body and the tails extend thru the second side of the dielectric body.

The present invention may also provide a contact member that comprises a frame and at least first and second inserts supported in the frame such that the first insert is offset from the second insert. Each of the first and second inserts has an interface side, and each of the first and second inserts supports at least one conductive spring member. Each spring member has a stationary end disposed inside of the first and second inserts, respectively, and a resilient end opposite the stationary end. The resilient end of each spring member has a rounded portion. The rounded portions extend thru the interface side of the first and second inserts, respectively, such that the rounded portions are exposed, thereby allowing the rounded portions to engage mating contacts.

The present invention may further provide a connector assembly that comprises at least a first connector component and a housing that has an inner receiving area and a connector holding portion at a perimeter of the receiving area for holding the first connector component. The connector holding portion defines an alignment channel. An alignment member supports the first connector component and the alignment member has a cross-sectional shape substantially the same as a cross-sectional shape of the alignment channel of the connector holding portion. The alignment member is slidably received in the alignment channel in an insert direction. A tolerance member is engaged with both the alignment member and the connector holding portion of the housing, wherein as the alignment member slides in the alignment channel, the tolerance member biases the alignment member in a direction opposite the insert direction The present invention may yet further provide a rocket launcher connector assembly that comprises a first connector component coupled to a launch tube and the first connector component includes a dielectric body that has at least first and second steps and a sloped surface therebetween at a mating interface of the dielectric body. The at least first and second contacts are supported by the dielectric body in the first and second steps, respectively. Each of the first and second contacts have a substantially flat pad at one end and a tail at an opposite end, wherein the pads are exposed at the mating interface of the dielectric body and the tails that extends through a side of the dielectric body opposite the mating interface. A second connector component is coupled to a rocket. The second connector component includes a frame and at least first and second inserts supported in the frame such that the first and second inserts are offset from one another. Each of the first and second inserts have an interface side configured to engage the mating interface of the first connector component and each of the first and second inserts support at least one conductive spring member. Each spring member has a stationary end and a resilient end opposite the stationary end. The resilient end has a rounded portion. The rounded portions extend thru the interface sides of the first and second inserts, respectively, such that the rounded portions are exposed, thereby allowing the rounded portions to engage the pads of the first connector component. A housing has an inner receiving area and a connector holding portion at a perimeter of the receiving area for holding the first and second connector components. The connector holding portion defines an alignment channel. The alignment member supports the first connector component and the alignment member is slidably received in the alignment channel in an insert direction. A tolerance member is engaged with both the alignment member and the connector holding portion of the housing, wherein as the alignment member slides in the alignment channel, the tolerance member biases the alignment member in a direction opposite the insert direction.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Referring to FIGS. 1-3, 4*a*, 4*b*, 5, 6*a*, 6*b*, 7, 8, 9*a* and 9*b*, the present invention provides an electrical connector assembly 100 that is preferably used on a rocket launcher. The configuration of the connector assembly 100 allows multiple reuses of the components of the connector assembly, facilitates blind-mate of the components, provides float in the support of the connector assembly, and provides longer lasting components. The assembly 100 is, preferably designed to reside in a minimal dimensional envelope relative to the circumference of a launch tube to allow tubes in multi-tube launchers to be placed in close proximity to one another.

Figure 1:
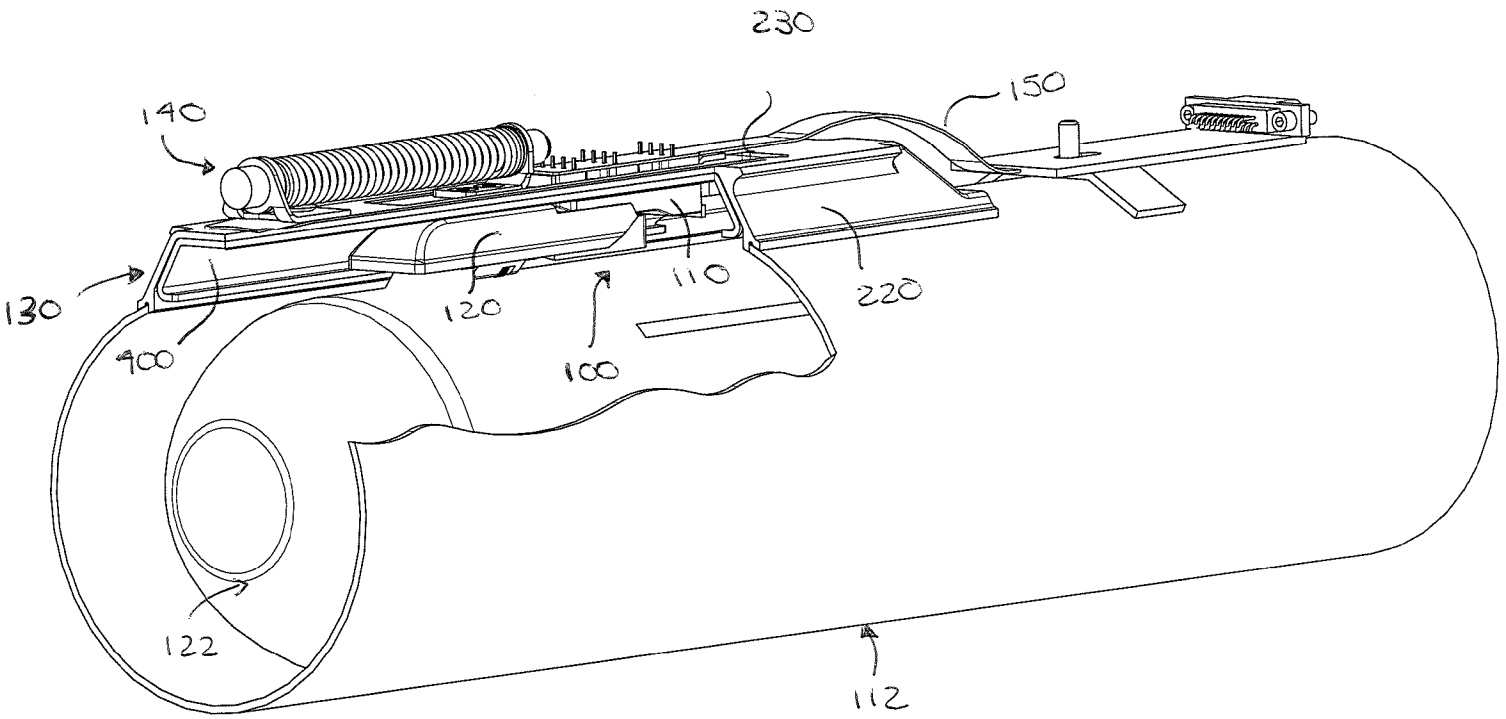
FIG. 1 is a perspective view of a rocket launcher and connector assembly according to an exemplary embodiment of the invention, showing a portion of the launcher housing removed and a rocket received in the housing.
Figure 2:
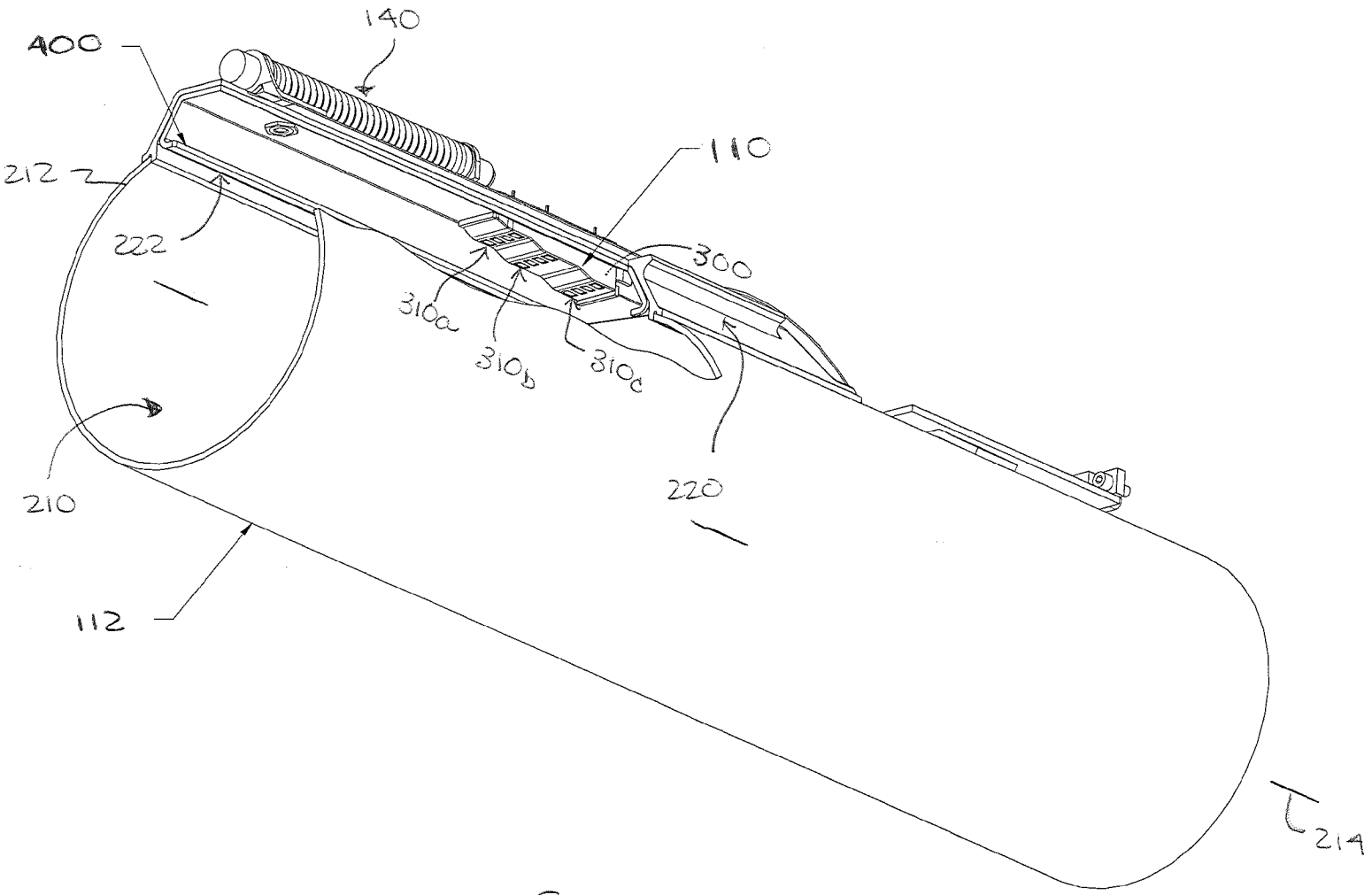
FIG. 2 is a perspective view of the rocket launcher and connector assembly illustrated in FIG. 1, showing a portion of the housing and some connector components removed.

The connector assembly 100 in accordance with an exemplary embodiment of the present invention generally includes a first connector component 110 coupled to a housing 112, such as launch tube of the rocket launcher, and a second connector component 120 that may be coupled to a rocket 122, for example, as best seen in FIGS. 1 and 2. The present invention may also include an alignment feature 130 that facilitates mating of the components 110 and 120 and a tolerance member 140 that provides axial tolerance or float in the support of the connector assembly 100 in the housing 112.

As seen in FIGS. 1-3, 4*a* and 4*b*, the first connector component 110 generally includes a dielectric body 300 that supports a plurality of contacts 310, preferably arranged in rows in a stepped configuration. The dielectric body 300 may include opposite first and second ends 302 and 304 and opposite first and second sides 306 and 308 extending between. The first side 306 is configured to be mating interface for mating with the second connector component 120. The second side 308 is adapted to engage the rocket launcher control (not shown) via the contacts 310 and a flexible printed circuit board 150.

The first side 306 of the body 300 preferably includes a plurality of steps, such as first, second and third steps 320, 322, and 324. A first sloped surface 330 is located between the body's first end 302 and the first step 320, a second sloped surface 332 is located between the first and second steps 320 and 322, and a third sloped surface 334 is located between the second and third steps 322 and 324. The steps 320, 322, and 324 and the sloped surfaces 330, 332, and 334 create a stepped mating interface; wherein the sloped surfaces 330, 332, and 334 generally slope in a direction from the first end 302 to the second end 304 such that the depth of the side 306 at the second end 304 is larger than the depth of the side 306 at the first end 302. Disposed in each step 320, 322 and 324 of the body is a row of openings 340*a*, 340*b*, and 340*c*, respectively, for receiving the contacts 310.

Figure 3:
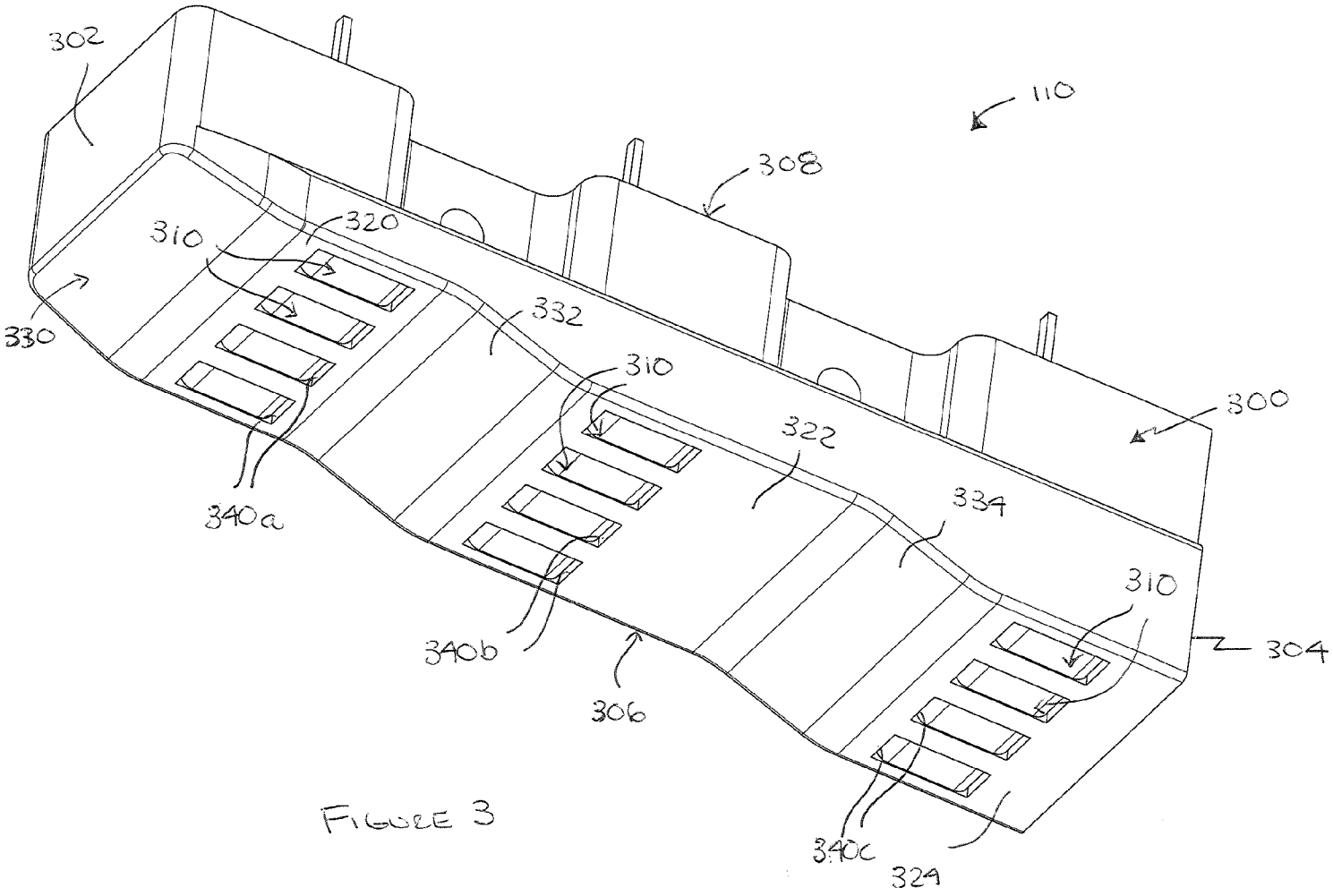
FIG. 3 is a perspective view of a contact member of the rocket launcher and connector assembly illustrated in FIG. 1.
Figure 8:
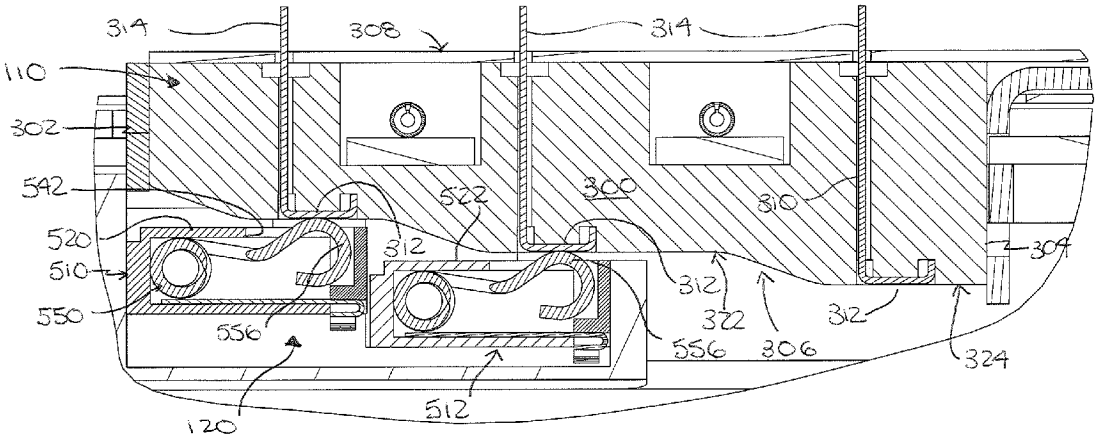
FIG. 8 is an enlarged view of a portion of the rocket launcher and connector assembly illustrated in FIG. 7.

As best seen in FIGS. 3 and 8, each contact 310 extends through the dielectric body 300 and may include a pad 312 at one end and a tail 314 at an opposite end thereof. The pads 312 are substantially flat and provide surface areas for engaging mating contacts. The tails 314 extend out of the second side 308 of the dielectric body 300 and are configured to be coupled to a printed circuit board, such as the flexible PCB 150, in any known manner. A first row 310*a* of the contacts 310 are aligned with the row of openings 340*a* such that each pad 312 of the contacts 310*a* are received in each opening 340*a*, respectively, thereby exposing the pads 312 at the first or mating side 306 of the dielectric body 300. Similarly, a second row 310*b* of the contacts 310 are aligned with the row of openings 340*b* and a third row 310*c* of the contacts are aligned with the row of openings 340*c* such that the pads 312 of both rows of contacts 310*b* and 310*c* are exposed at the first or mating side 306 of the dielectric body. Although it is preferable that the contacts 310 be arranged in rows as shown, the contacts 310 may have any known arrangement including one contact per step 320, 322, and 324 of the dielectric body 300 as long as the contacts 310 are positioned to engage mating contacts of the second connector component.

Figure 4A:
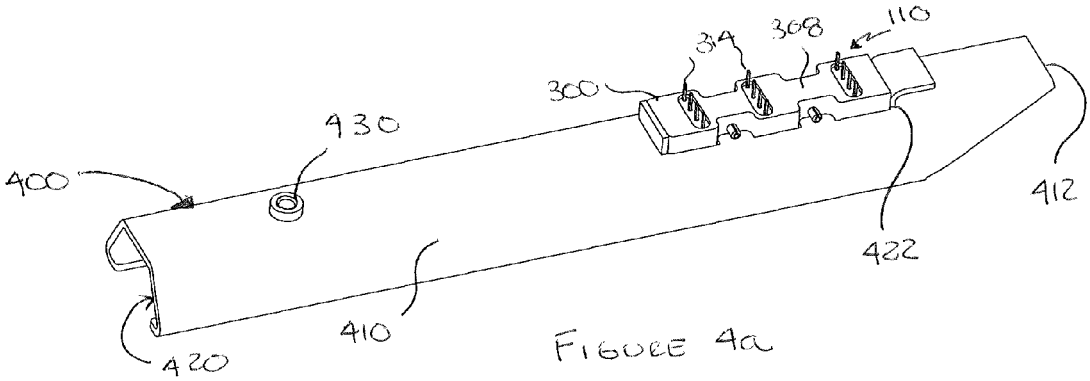
FIG. 4*a* is a perspective view of the contact member illustrated in FIG. 3 supported by an alignment member.
Figure 4B:
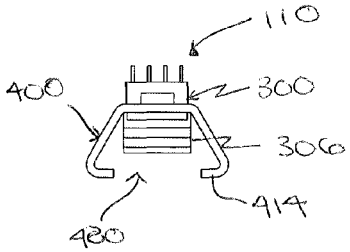
FIG. 4*b* is an end view of the contact member and alignment member illustrated in FIG. 4*a;*
Figure 5:
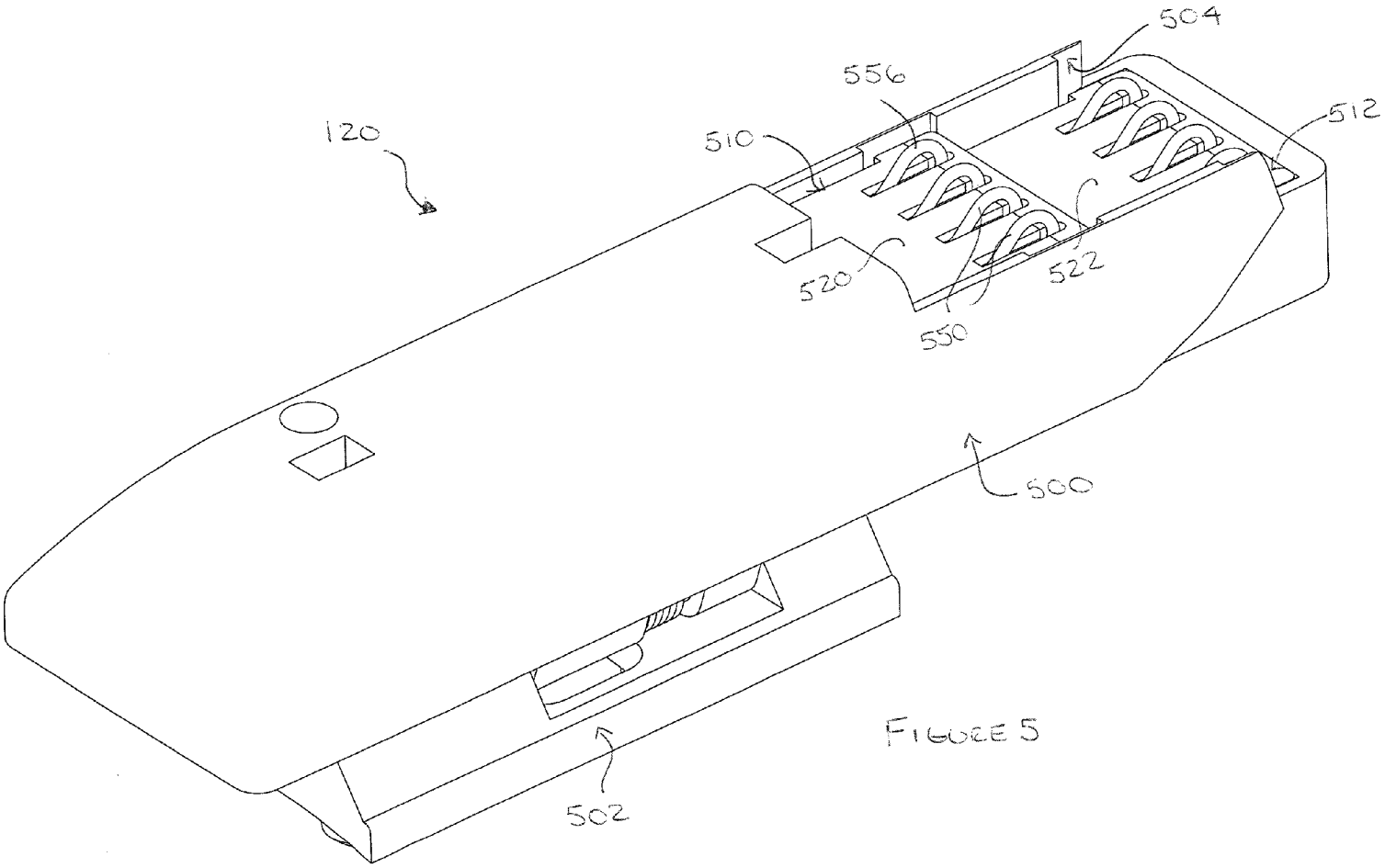
FIG. 5 is a perspective view of another contact member of the rocket launcher and connector assembly illustrated in FIG. 1, showing the contact member supported in a guide frame.

As seen in FIGS. 2, 4*a* and 4*b*, the dielectric body 300 is preferably coupled to an alignment member 400 that forms part of the alignment feature 130 of the present invention. The alignment member 400 may have a wall 410 with a lead-in end portion 412 for insertion into the housing 112. The wall 410 includes inwardly extending flanges 414 that define an inner channel area 420 of the alignment member 400. The inner channel area 420 is configured to receive the second connector component 120. An opening 422 is located in the wall 410 that is sized to accommodate the dielectric body 300 such that the first side 306 of the body 300 extends into the inner channel area 420 and the second side 308 along with the tails 314 of the contacts 310 extend outside of the alignment member 400. A fastener 430 is provided in the wall 410 of the alignment member 400 spaced from the dielectric body 300. The fastener 430 is adapted to engage the tolerance member 140.

As seen in FIGS. 5, 6*a*, 6*b*, and 8, the second connector component 120 may include a frame 500 that supports at least first and second inserts 510 and 512 such that the inserts 510 and 512 are offset from one another to correspond to the steps of the first connector body 110. The inserts 510 and 512 may be supported in that offset arrangement of pins or other known mechanism in the frame 500. The frame 500 may have an attachment member 502 remote from the inserts 510 and 512 for coupling the second connector component 120 to a rocket. The frame 500 is preferably shaped such that it is receivable in the inner channel area 420 of the alignment member 400 of the first connector component 110. Each insert 510 and 512 has an interface side 520 and 522 for engaging the first side 306 of the dielectric body 300 of the first connector component 110. An opening 504 in the frame 500 provides access to the interface sides 520 and 522 of the inserts.

Figure 6A:
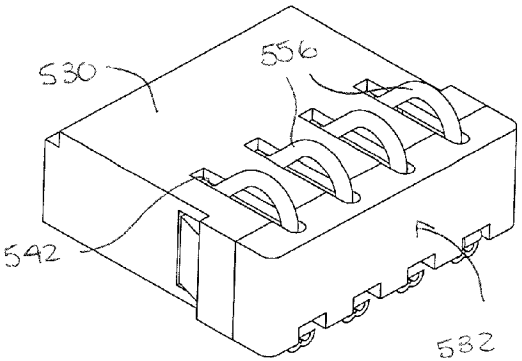
FIG. 6*a* is a perspective view of an insert of the contact member illustrated in FIG. 5.
Figure 6B:
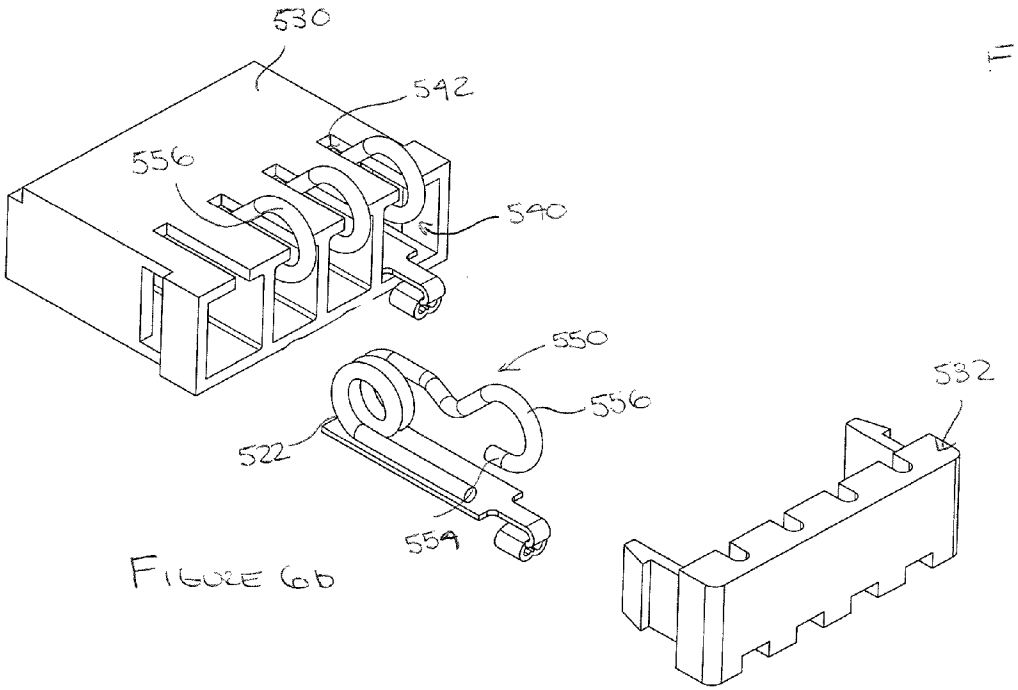
FIG. 6*b* is an exploded perspective view of the insert illustrated in FIG. 6*a;*

Each insert 510 and 512 may be formed of a main part 530 and a secondary part 532 that couples to the main part 530, as seen in FIGS. 6*a* and 6*b*. The main part 530 may include a plurality of channels 540 uniformly spaced therein that each include a slot 542. Each channel 540 supports a conductive spring member or contact 550. Each spring member 550 has one end 552 that is stationary and is designed to be received inside of a respective channel 540. Each spring member 550 also has a resilient end 554 opposite the stationary end 552 that has a rounded portion 556 received in the slot 542 of the respective channel 540 such that the rounded portions 556 of the spring members 550 extend through the interface sides 520 and 522 of the inserts and are thus exposed for engagement with the pads 312 of the first connector component 110. The secondary part 532 of each insert 510 and 512 is preferably designed to snap into the main part 530, thereby closing off the channels 540. Alternatively, the inserts can be formed of a single part.

Figure 7:
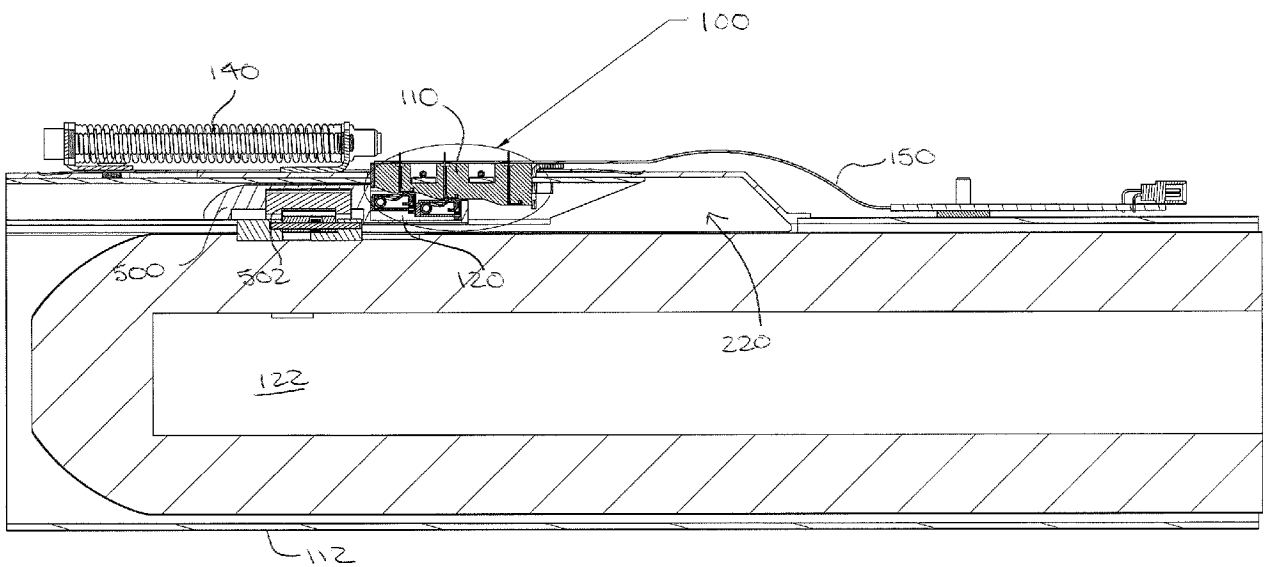
FIG. 7 is a cross-sectional view of the rocket launcher and connector assembly illustrated in FIG. 1.

As seen in FIGS. 1, 2 and 7, the assembly 100 of the connector components 110 and 120 are received in the housing 112. The housing 112 includes an inner receiving area 210 for holding the rocket 122 and a connector holding portion 220 at the perimeter of the housing 112 for holding the connector components 110 and 120. The housing 112 has an open launch end 212 and defines a longitudinal axis 214. The rocket 122 is preferably received in the housing 112 such that it is behind the launch end 212 of the housing 112, as seen in FIG. 7. The connector holding portion 220 can be either integral with the housing 112 so as to form a unitary one-piece housing or it can snap onto the housing 112. The connector holding portion 220 defines an alignment keyway or channel 222 that forms part of the alignment feature 130 of the present invention. The alignment channel 222 is open at the launch end 212 of the housing 112 and is shaped to accommodate the alignment member 400 of the connector component 110. The alignment channel 222 and the alignment member 400 preferably have substantially the same cross-section shape such that the alignment channel 222 can receive the alignment member 400 in a generally sliding telescoping manner.

To assemble the first connector component 110 with the housing 112 and specifically the connector holding portion 220, the lead-in end portion 412 of the alignment member 400 is inserted into the open end of the alignment channel 222. Once inserted, the first side 306 of the connector component 110 faces inside of the housing 112 and the second side 308 extends though an opening 230 (FIG. 1) in the connector holding portion 220 to face the outside of the housing 112. The contacts pads 312 are preferably oriented such that their surfaces are substantially parallel with the longitudinal axis 214 of the housing 112. Such orientation reduces degradation of the contacts when the rocket is launched. The opening 230 has a predetermined length to provide axial float to the connector assembly 100 in the connector holding portion 220 via the tolerance member 140. The fastener 430 of the alignment member 400 extends through the opening 230 to couple to the tolerance member 140, as best seen in FIG. 2. Alternatively, a second opening may be provided in the connector holding portion 220 that allows the fastener 430 to engage the tolerance member 430.

Figure 9A:
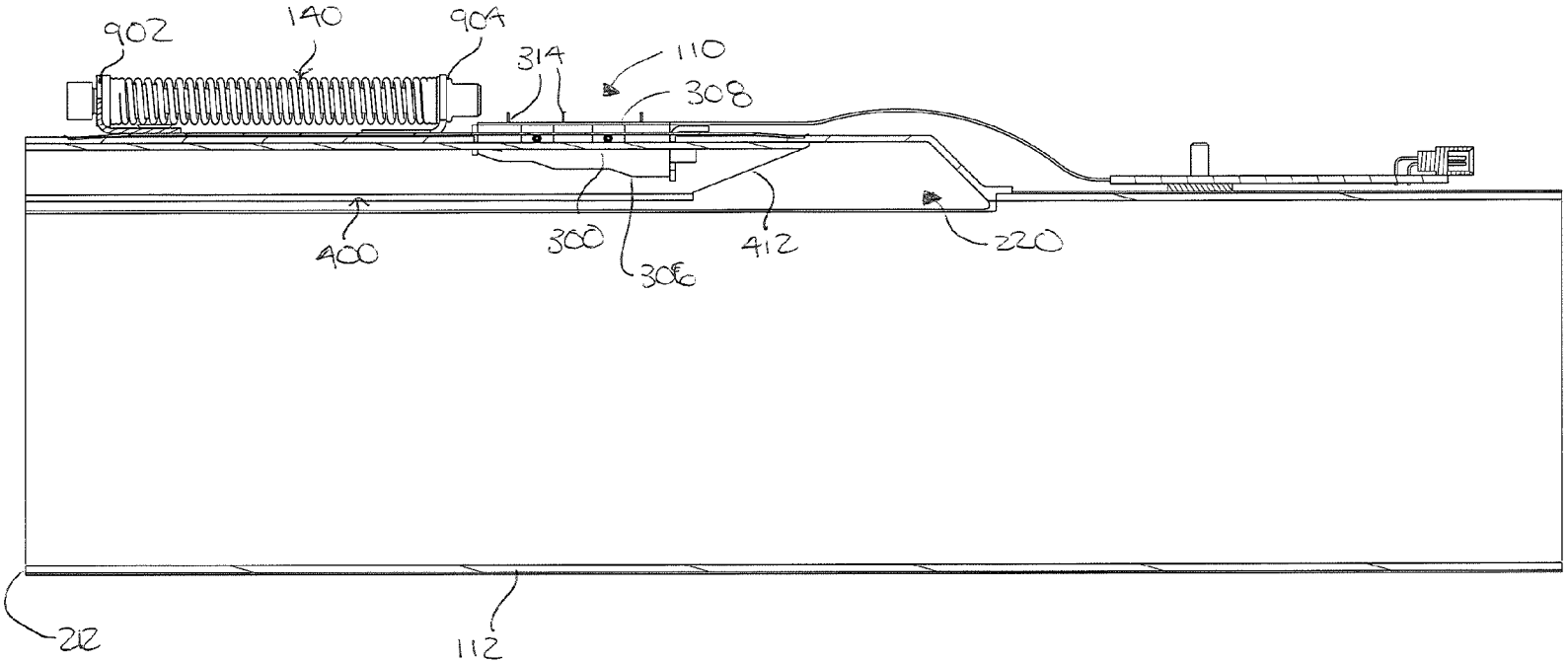
FIG. 9*a* is a cross-sectional view of the rocket launcher illustrated in FIG. 9, showing the contact member and alignment member is a front position.
Figure 9B:
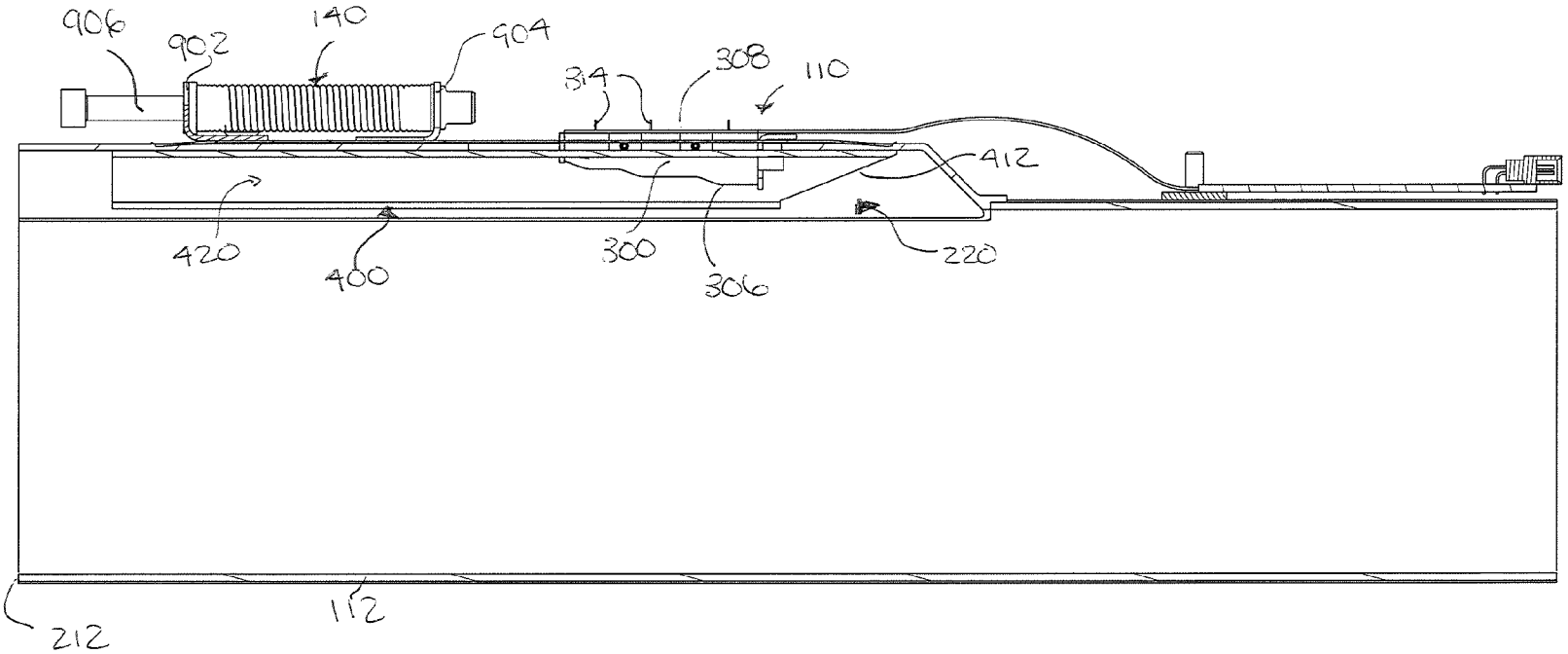
FIG. 9*b* is a cross-sectional view similar to FIG. 10*a*, showing the contact member and alignment member is an aft position.

The tolerance member 140 is preferably a compression or extension spring that is coupled both to the alignment member 400 and the connector holding portion 220 of the housing 112 by first and second brackets 902 and 904, respectively, as seen in FIGS. 9*a* and 9*b*. The spring member 140 is supported by a rod 906 between the brackets 902 and 904. The first bracket 902 may be an L-shaped bracket that is attached at one end to a first end 142 of the spring member 140 and another end that is coupled with the fastener 430 of the alignment member 400. The first bracket 902 is movable with respect to the second bracket 904 which is stationary and fixed to the housing 112 at the connector holding portion 220. The first bracket 902 moves along the rod 906 toward the stationary bracket 904 to compress the spring member 140, as seen in FIGS. 9*a* and 9*b* showing the spring member in uncompressed and compressed positions, respectively. Because the spring member 140 is operably connected to the alignment member 400, the first connector component 110 can slide inside of the housing's connector holding portion 220 with a predetermined axial float.

When the rocket 122 is installed in the launcher housing 112, the rocket is inserted through the housing's launch end 212 and into the receiving area 210. In doing so, the attachment member 502 of the second or rocket connector component 120 is aligned with the alignment member 400 of the first or launcher connector component 110 such that the component 120 slides in the inner channel area 420 until the rows of spring members 550 in the second insert 512 engage the pads 312 in the second step 322 of component 110 and the rows of spring members 550 in the first insert 510 engage the pads 312 in the first step 320 of component 110, as best seen in FIG. 8. Although the spring members 550 of the rocket connector component 120 are shown as engaging the first and second rows 340*a* and 340*b* of pad contacts 312 of the stepped dielectric body 300, additional spring member 550 may be provided for engaging the pads 312 of the third row 340*c*. The third row 340*c* of contacts may also be configured to accept an adaptor connector, that allows a coax connector to be plugged into the connection assembly. This allows currently fielded, unguided rockets with electronic fuses, to be fused through the smart interface connector described in the patent application. More rows of contacts are also envisioned for future expansion of the connector with spring contacts.

The stepped configuration of the dielectric body 300 allows a multitude of contacts to be arranged such that they exist in a minimal space relative to the circumference of the housing or launch tube. It is advantageous for the connector assembly 100 to exist in a minimal space, thus allowing the launch tubes in multi-tube launcher systems to clustered more tightly, further allowing more launch tubes to be present in a prescribed multi-tube launcher volume.

In particular, the rounded portions 556 of the spring members 550 of the component 120 individually engage the substantially flat pads 312 of the component 110, as seen in FIG. 8. Because the resilient ends 554 (and the rounded portions 550) are resilient and biased outwardly, a positive electrical connection between the springs members 550 and pads 312 is insured. That also creates a releasable interference engagement between the connector components and specifically between the spring members 550 and the pads 312, without hindering the launch of the rocket 122 from the housing.

Once the rocket 122 is inserted and the components 110 and 120 are mated, the tolerance member 140 allows the assembly 100 of the components 110 and 120 to slide or float axially between forward and aft positions, as seen in FIGS. 9*a* and 9*b*, respectively. For clarity, the second connector component 120 is not shown in FIGS. 9*a* and 9*b*. The float provided by the tolerance member 140 allows relative motion between the second connector component 120 and the housing 112, which allows the connector assembly to remain engaged regardless of the position of the rocket relative to the housing 112.

In the front position, the tolerance member 140 is not compressed and the movable bracket 902, which is connected to the first connector component 110, is located near the launch end 212 of the housing 112. As the rocket is inserted into the housing 112, the tolerance member 140 allows axial movement to the aft position as the rocket component connector 120 engages with the launcher connector component 110. In the aft position, the moveable bracket 902 moves toward the stationary bracket 904 and the tolerance member 140 is compressed to provide axial float while also preventing the connector components from being over-inserted too far into the housing 112. The dielectric body 300 of the first connector component 110 moves within the opening 230 of the housing's connector holding portion 220 as the tolerance member 140 is compressed and released.

While particular embodiments have been chosen to illustrate the invention, it will be understood by those skilled in the art that various changes and modifications can be made therein without departing from the scope of the invention as defined in the appended claims.

What is claimed is:

1. A connector assembly, comprising:

at least a first connector component;

a housing having an inner receiving area and a connector holding portion at a perimeter of said receiving area for holding said first connector component, said connector holding portion defining an alignment channel;

an alignment member supporting said first connector component, said alignment member having a cross-sectional shape substantially the same as a cross-sectional shape of said alignment channel of said connector holding portion, said alignment member being slidably received in said alignment channel in an insert direction; and a tolerance member engaged with both said alignment member and said connector holding portion of said housing, wherein as said alignment member slides in said alignment channel, said tolerance member biases said alignment member in a direction opposite said insert direction.

2. A connector assembly in accordance with claim 1, wherein said tolerance member is a compression spring.

3. A connector assembly in accordance with claim 1, further comprising a second connector component received in said alignment member of said first connector component, said second connector component being configured to mate with said first connector component.

4. A connector assembly in accordance with claim 1, wherein said alignment member is engaged with said tolerance member by a movable bracket that is slidable with respect to said connector holding portion.

5. A connector assembly in accordance with claim 1, wherein said connector holder portion is engaged with said tolerance member by a stationary bracket fixed to said housing.

6. A connector assembly in accordance with claim 1, wherein said alignment member includes a narrowed lead-in end portion.

7. A connector assembly in accordance with claim 1, wherein said cross-sectional shape of both of said alignment channel and said alignment member is substantially trapedozial.

8. A rocket launcher connector assembly, comprising:

a first connector component coupled to a launch tube, said first connector component including a dielectric body having at least first and second steps and a sloped surface therebetween at a mating interface of said dielectric body, and at least first and second contacts being supported by said dielectric body in said first and second steps, respectively, each of said first and second contacts having a substantially flat pad at one end and a tail at an opposite end, wherein said pads are exposed at said mating interface of said dielectric body and said tails extending through a side of said dielectric body opposite said mating interface;

a second connector component coupled to a rocket, said second connector component including a frame, at least first and second inserts supported in said frame such that said first and second inserts are offset from one another, each of said first and second inserts having an interface side configured to engage said mating interface of said first connector component, and each of said first and second inserts supporting at least one conductive spring member, each spring member having a stationary end and a resilient end opposite said stationary end, said resilient end having a rounded portion, said rounded portions extending thru said interface sides of said first and second inserts, respectively, such that said rounded portions are exposed, thereby allowing said rounded portions to engage said pads of said first connector component;

a housing having an inner receiving area and a connector holding portion at a perimeter of said receiving area for holding said first and second connector components, said connector holding portion defining an alignment channel;

an alignment member supporting said first connector component, said alignment member being slidably received in said alignment channel in an insert direction; and a tolerance member engaged with both said alignment member and said connector holding portion of said housing, wherein as said alignment member slides in said alignment channel, said tolerance member biases said alignment member in a direction opposite said insert direction.

9. A rocket launcher connector assembly according to claim 8, wherein said second connector component is received in an inner channel area of said alignment member of said first connector component.

10. A rocket launcher connector assembly according to claim 8, wherein said alignment member is engaged with said tolerance member by a movable bracket that is slidable with respect to said connector holding portion; and said connector holder portion is engaged with said tolerance member by a stationary bracket fixed to said housing.

11. A rocket launcher connector assembly according to claim 8, wherein said tolerance member is a compression spring.

12. A rocket launcher connector assembly according to claim 8, wherein a row of said first contacts is disposed in said first step of said dielectric body; and a row of said second contacts disposed in said second step of said dielectric body.

13. A rocket launcher connector assembly according to claim 12, wherein each of said first and second inserts of said second connector component supports a row of said spring members, respectively, and each of said rows of said spring members engages said rows of said first and second contacts, respectively.

* * * * *